United States Patent [19]

Butcher

[11] Patent Number: 4,704,312

[45] Date of Patent: Nov. 3, 1987

[54] THERMAL INSULATING MATERIAL

[75] Inventor: David H. Butcher, Kirdford, United Kingdom

[73] Assignee: World Patent Improvements S.A., Luxembourg

[21] Appl. No.: 936,767

[22] Filed: Dec. 2, 1986

[51] Int. Cl.[4] ..... E04B 1/76; E04B 2/00

[52] U.S. Cl. ..... 428/12; 428/72; 428/77; 428/188; 52/406

[58] Field of Search ..... 428/12, 72, 77, 188; 52/406

[56] References Cited

U.S. PATENT DOCUMENTS

| | | | |
|---|---|---|---|
| 2,955,063 | 10/1960 | Driscoll | 52/406 |
| 4,334,395 | 6/1982 | Dyar | 52/407 |
| 4,421,203 | 12/1983 | Bergamini | 181/290 X |
| 4,422,273 | 12/1983 | Dyar | 52/407 |
| 4,590,727 | 5/1986 | Ghahremani et al. | 52/406 |

*Primary Examiner*—Alexander S. Thomas
*Attorney, Agent, or Firm*—A. W. Breiner

[57] ABSTRACT

A thermal insulating material is formed from layers of reflective sheet material (7) and has expanders (10,11) operable to convert it, on the application of transverse tension, from a closed state to a state in which the layers are held spaced apart. The material is provided with boundary portions for securing it e.g. to the underside of ceiling joists (4) and with deflector means (12) operable to space the material from a planar covering when such covering is applied. Advantageously the deflector means is provided flat and has a triangular cross-section when erected.

9 Claims, 6 Drawing Figures

THERMAL INSULATING MATERIAL

FIELD OF THE INVENTION

Figure 1:
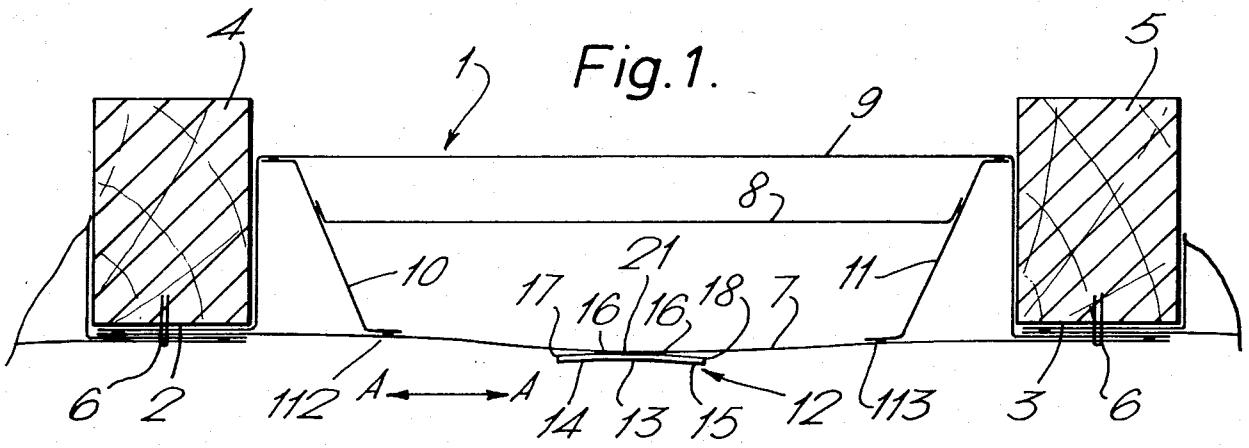

The present invention relates to thermal insulating material, and especially to such material used for the thermal insulation of buildings.

BACKGROUND TO THE INVENTION

Various proposals have been made for the provision of thermal insulating materials which, when installed, provide spaced-apart layers - usually of paper or card material - which are faced with a radiation barrier material of the reflective type, usually aluminium foil. Such a material provides insulation by reflecting energy received as radiation. It also has a low emissivity for heat energy received by conduction or convection. The material is usually provided in a folded or rolled compact form which, after unrolling or unfolding, is converted to provide the spaced-apart layers by the pivotal action of in built expanders produced by tensioning the material transversely.

Such materials are described and illustrated in, for example, U.S. Pat. Nos. 4,421,203 and 4,590,727.

The materials are normally used for lining roofs or flooring, being applied for example to lofts. Installation by securing the material to the upper side of the ceiling joists exposed in a loft is a simple matter. Installation on the undersides of ceiling joists is also required in many cases. This involves attaching the material to the vertical faces of the joists so that it is spaced apart from the ceiling. Such spacing is especially necessary when the reflective material of the bottom layer is downwardly facing. If the material contacts the upper side of the ceiling it receives heat by conduction and, since its conductivity is high, makes little or no contribution to the required insulation.

OBJECTS OF THE INVENTION

An object of the present invention is to provide a material which is readily attached, when required, to the underside of ceiling joists, while avoiding the foregoing difficulty.

GENERAL DESCRIPTION OF THE INVENTION

In accordance with the present invention there is provided a thermal insulating material of the type in which a main length of, and at least one further length of, sheet material are secured together in face to face relationship and are connected with expanders positioned in the neighbourhood of their edges, said main length and said further lengths each having at least one face constituted by a radiation barrier material of the reflective type, the arrangement being such that the insulating material can be converted from a closed state, in which the layers have longitudinal folds, to an unfolded opened state, by applying transverse tension to said main length and thereby opening the folds and causing the expanders to space and hold the lengths apart over a major part of their widths with the main length substantially flat, said material having longitudinal boundary portions which in the tensioned material, project outwardly in the transverse direction from the level of the main length, said main length being provided with deflector means for so deflecting it in the direction of said further length or lengths of sheet material at least when a planar material contacts the boundary portions simultaneously that a substantial proportion of the area of said main length is spaced away from said planar material.

Installation of the insulating material of the invention is readily effected by nailing or stapling it by its boundary portions to the underside of the joists. For this purpose the material preferably has the boundary portions each reinforced by a reinforcing strip, formed for example of a card-like material, which resists tearing action.

In a convenient and preferred arrangement the lengths of sheet material aforesaid are formed of cellulosic material, preferably paper card material. A card material of the kind used in the manufacture of packaging cartons gives satisfactory results. Aluminium or other metallic foil is a convenient material for the radiation barriers. The foil is readily laminated to the sheet material. For safety reasons cellulosic or other flammable material, when employed as a sheet material (or elsewhere e.g. for constructing the expanders or the deflector means) is desirably treated with a flame retardant.

Another form of sheet material is synthetic resinous film, e.g. polyvinyl chloride, polyethylene, polypropylene or polytetrafluoroethylene. In this case one or both faces of the material may be provided with an aluminium or other reflective coating formed in situ rather than being applied by lamination.

In a preferred arrangement, the deflector means is secured to the main length of sheet material. This arrangement is more convenient, in installation, than having the deflector means supplied separately.

To enable the insulating material, complete with the deflector means, to be supplied in a rolled or folded form, the deflector means is advantageously provided in a flat state, and is convertable from the flat state to an erected state.

An arrangement which is especially preferred because of its simplicity is to provide the deflector means in the form of a single, centrally located deflector. Where this deflector is provided in a flat state and is so arranged and constituted that it may be erected to, and secured in, a projecting form, an arrangement is obtained which is convenient in manufacture, storage, distribution and on-site application.

The deflector, or each deflector, is advantageously provided in such form that it may be secured in the erected state without the application of separately provided material or components e.g. staples, clips, adhesives or adhesive activators. For this purpose it may be provided, at regions which are to be secured together, with coatings of impact adhesive of the type which unite when brought together but do not adhere to adhesive-free areas. Another, and more preferred, arrangement is to form the deflector with mechanically interlocking edge portions.

A deflector having a generally triangular cross-section when in the erected state is advantageous in that it has a stable configuration with its angles determined solely by linear dimensions. Having its base secured to the sheet material distributes the load. The concentrated apex loading is normally unimportant when borne by the upper side of a ceiling because of the mechanical properties of the ceiling materials.

SPECIFIC DESCRIPTION OF PREFERRED EMBODIMENTS

Figure 3:
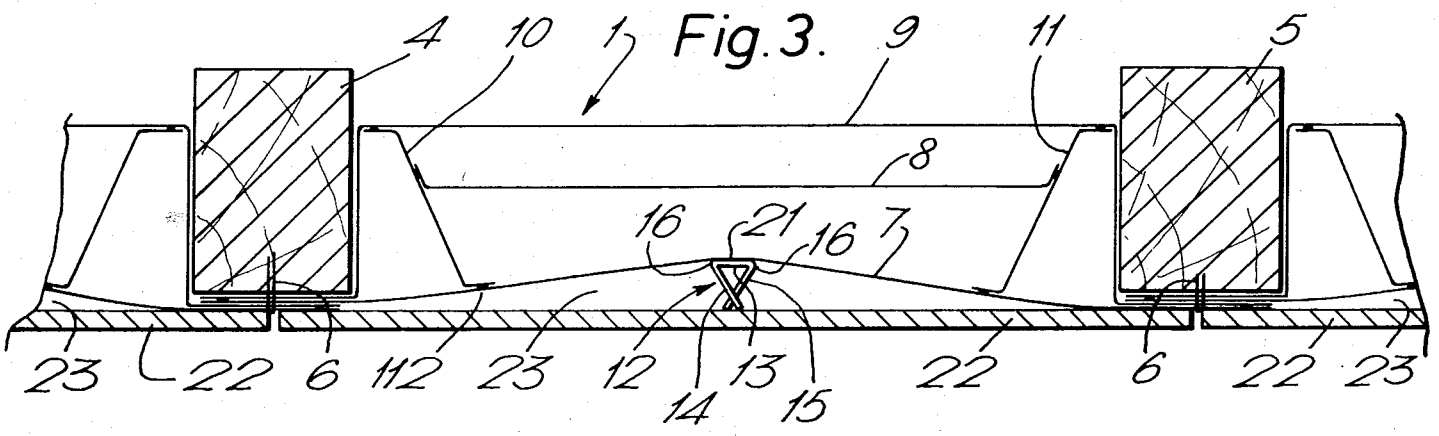
Figure 2:
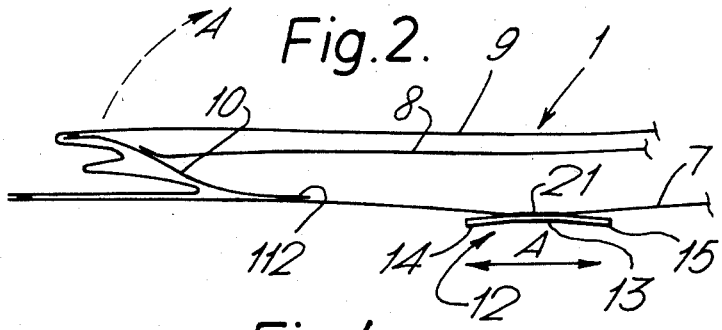
Figure 4:
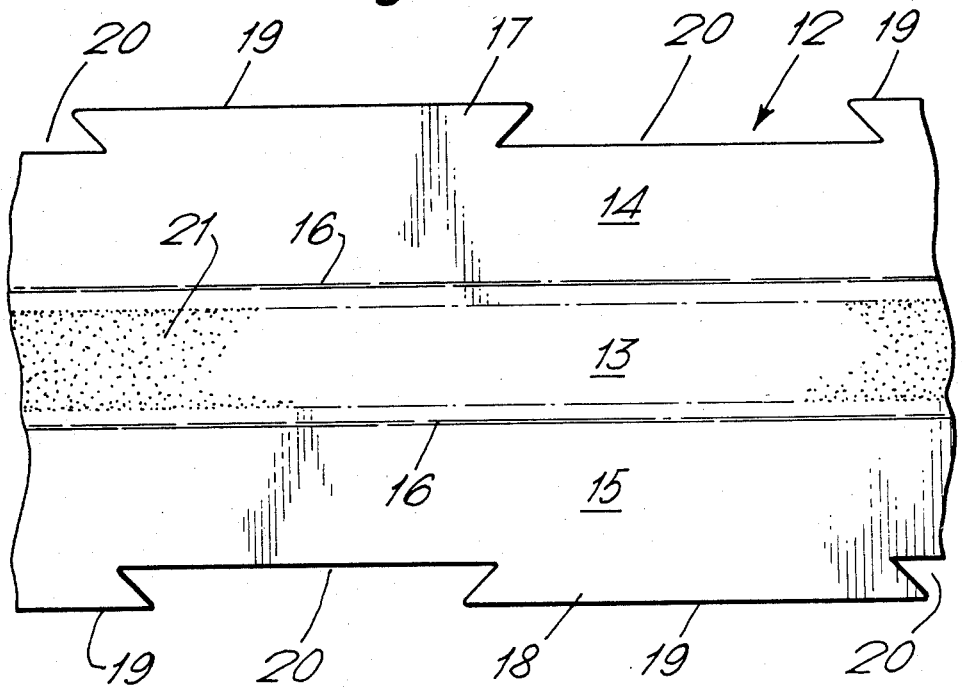
Figure 5:
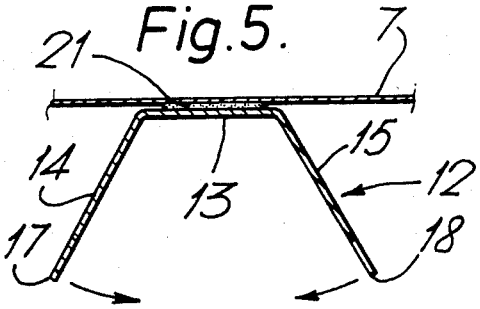
Figure 6:
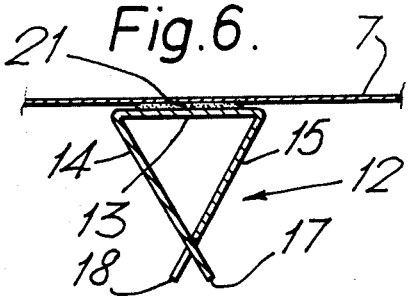

The following description in which reference is made to the accompanying drawings is provided in order to illustrate the invention. In the drawings:

FIG. 1 shows, in cross-section, an example of an insulating material according to the invention applied to ceiling joists, FIG. 2 shows the same material in a stage of its transition from the folded state in which it is supplied, FIG. 3 shows the effect of securing a ceiling to the joists, FIG. 4 is a plan showing a part of the deflector incorporated in the insulating material, and FIGS. 5 and 6 show the deflector in further detail.

In the arrangement shown in FIG. 1, a flameproofed thermal insulating material 1 is secured by flat boundary parts 2 and 3 to the undersides of an adjacent pair of ceiling joists by tacks (or staples) 6.

Material 1 has a main length of a stout, paper-like material 7 and two further lengths 8 and 9. Length 7 has aluminium foil laminated to its lower face. The lengths are secured in a known manner to a pair of expanders 10 and 11.

As the material is pulled in the direction A—A it is converted from the flat, and normally also rolled, state in which it is supplied with the layers folded longitudinally to the open state shown in FIG. 1. Expanders 10 and 11 swing about positions 112 and 113, at which they are secured to length 7 (see arrow A in Figure 2) to bring the lengths into, and hold them in, the said open state.

A centrally located deflector 12 extends along the centre of the outer length 7. Its width is divided into an inner portion 13 and two equal outer portions 14 and 15 by longitudinal creases 16. The longitudinal outer edges 17 and 18 are shaped to provide a series of projections 19 opposite complementary recesses 20. Inner portion 13 is adhesively secured along the centre of length 7, the adhesive being shown with an exaggerated thickness at 21 in FIG. 1.

After the material has been secured to the joists as shown in FIG. 1, plasterboard ceiling components 22 are tacked or otherwise secured to the undersides of the joists. Reaction with the deflector 12 produces a space 23 between the plasterboard and length 7 to give the advantages hereinbefore described. The pivotal moments produced upon outer portions 14 and 15 by reaction with the plasterboard act to force edges 17 and 18 together. Thus the projections 19 and recesses 20 which secure edges 17 and 18 together during installation are not required to withstand loading in the completed ceiling.

The single centrally located deflector 12 is normally adequate. A plurality of deflectors may be provided when preferred. Deflectors in the neighbourhood of the expanders can modify the action thereof but such modification can be allowed for in the construction of the material, e.g. a tendency to cause length 8 to sag may be reduced or eliminated by giving length 8 a reduced width.

Whilst the primary purpose of the material is for the construction of insulated ceilings, it will be recognised that it can be employed in a similar manner in the construction of walls.

The preferred arrangement is to provide the deflector means as part of the insulating material assembly. It may however, less conveniently, be provided separately. For example it may be in the form of one or more rods or tubes sandwiched between the installed insulating material and the ceiling-finished material. Providing the ceiling finishing material with the deflector means attached is possible but such an arrangement interferes with the transport and storage of the finishing material.

I claim:

1. In a thermal insulating material of the type in which a main length of, and at least one further length of, sheet material are secured together in face to face relationship and are connected with expanders positioned in the neighbourhood of their edges, said main length and said further lengths each having at least one face constituted by a radiation barrier material of the reflective type, the arrangement being such that the insulating material can be converted from a closed state, in which the layers have longitudinal folds, to an unfolded opened state, by applying transverse tension to said main length and thereby opening the folds and causing the expanders to space and hold the lengths apart over a major part of their widths with the main length substantially flat, the improvement consisting of the provision of longitudinal boundary portions which in the tensioned material project outwardly in the transverse direction from the level of the main length, said main length being provided with deflector means for so deflecting it in the direction of said further length or lengths of sheet material at least when a planar material contacts the boundary portions simultaneously that a substantial proportion of the area of said main length is spaced away from said planar material.

2. The material of claim 1 in which said boundary portions are each reinforced by a reinforcing strip.

3. The material of claim 1 in which said lengths of sheet material are formed of cellulosic material.

4. The material of claim 1 in which the radiation barrier material is aluminium or other metallic foil.

5. The material of claim 1 in which the deflector means is secured to the main length of sheet material.

6. The material of claim 1 in which the deflector means is provided in a flat state and is convertible from the flat state to an erected state.

7. The material of claim 6 in which the deflector means has a generally triangular cross-section.

8. The material of claim 1 in which the deflector means is a single, centrally located deflector.

9. The material of claim 1 in which cellulosic material present in the product is treated with a flame retardant.

* * * * *